US009737786B2

(12) United States Patent
Holovicz

(10) Patent No.: US 9,737,786 B2
(45) Date of Patent: Aug. 22, 2017

(54) RUNNING SURFACE FOR A SKI AND CROSS-COUNTRY SKI

(71) Applicant: FISCHER SPORTS GMBH, Ried/Innkreis (AT)

(72) Inventor: Josef Holovicz, A-Mettmach (AT)

(73) Assignee: Fischer Sports GmbH, Ried/Innkreis (AT)

( * ) Notice: Subject to any disclaimer, the term of this patent is extended or adjusted under 35 U.S.C. 154(b) by 0 days.

(21) Appl. No.: 15/031,443

(22) PCT Filed: Oct. 21, 2014

(86) PCT No.: PCT/AT2014/050252
§ 371 (c)(1),
(2) Date: Apr. 22, 2016

(87) PCT Pub. No.: WO2015/058228
PCT Pub. Date: Apr. 30, 2015

(65) Prior Publication Data

US 2016/0263467 A1 Sep. 15, 2016

(30) Foreign Application Priority Data

Oct. 22, 2013 (AT) ..... A 50681/2013

(51) Int. Cl.
*A63C 7/06* (2006.01)
*A63C 5/04* (2006.01)

(52) U.S. Cl.
CPC ..... *A63C 7/06* (2013.01); *A63C 5/0428* (2013.01)

(58) Field of Classification Search
CPC ..... A63C 17/01; A63C 5/048; A63C 7/06; A63C 5/03; A63C 5/044; A63C 5/0422; A63C 5/04
See application file for complete search history.

(56) References Cited

U.S. PATENT DOCUMENTS 3,408,086 A * 10/1968 Bennett ..... A63C 5/0428 280/28
4,178,012 A 12/1979 Roth et al.
(Continued)

FOREIGN PATENT DOCUMENTS

AT 311 844 12/1973
CH 306 405 4/1955
(Continued)

OTHER PUBLICATIONS

English translation of the International Preliminary Report on Patentability and Written Opinion of the International Searching Authority mailed May 6, 2016, issued in International Application No. PCT/AT2014/050252.
(Continued)

*Primary Examiner* — Hau Phan
(74) *Attorney, Agent, or Firm* — Nixon & Vanderhye P.C.

(57) ABSTRACT

A running surface for a ski having a running surface profile that has slideback prevention elements with sliding surfaces which slope up counter to a sliding direction and merge into push-off flanks. The slideback prevention elements have at least one first ramp element having a longitudinally convexly curved sliding surface with a first radius of curvature (r1) and at least one second ramp element. The the second ramp element has a longitudinally convexly curved sliding surface with a second radius of curvature (r2) which is greater than that of the first ramp element.

28 Claims, 10 Drawing Sheets

(56) References Cited

U.S. PATENT DOCUMENTS 4,223,909 A * 9/1980 Danner ..... A63C 5/0428 280/604
4,440,418 A * 4/1984 Staufer ..... A63C 5/04 280/604
4,919,447 A * 4/1990 Jackson ..... A63C 7/06 280/604
5,167,552 A * 12/1992 Johnson, III ..... A63C 5/04 114/67 R
5,328,200 A * 7/1994 Pelizzari ..... A63C 5/0422 280/28
5,344,177 A * 9/1994 Rouser ..... A44B 18/0053 24/584.1
5,725,237 A * 3/1998 Krafft ..... A63C 5/044 280/609
5,727,807 A * 3/1998 Krafft ..... A63C 5/044 280/608
6,357,781 B1 * 3/2002 Jeandin ..... A63C 5/03 280/14.22
7,758,061 B2 * 7/2010 Staudinger ..... A63C 5/0428 280/608
8,061,731 B2 * 11/2011 Popenas ..... A63C 7/06 280/604
8,574,705 B2 * 11/2013 Hunter ..... A63C 17/01 280/87.042

FOREIGN PATENT DOCUMENTS

| | | |
|---|---|---|
| DE | 19 54 075 | 5/1971 |
| DE | 22 43 229 | 3/1973 |
| DE | 23 61 663 | 6/1975 |
| DE | 78 16 929 | 9/1978 |
| DE | 30 24 364 | 1/1982 |
| EP | 0 049 427 | 4/1982 |
| EP | 0 592 384 | 11/1997 |

OTHER PUBLICATIONS

International Search Report for PCT/AT2014/050252 mailed Feb. 25, 2015, 3 pages.
Written Opinion of the ISA for PCT/AT2014/050252 mailed Feb. 25, 2015, 5 pages.
Office Action for AT A 50681/2013-1 dated Oct. 22, 2013, 3 pages.

* cited by examiner

RUNNING SURFACE FOR A SKI AND CROSS-COUNTRY SKI

This application is the U.S. national phase of International Application No. PCT/AT2014/050252 filed 21 Oct. 2014 which designated the U.S. and claims priority to Austrian Patent Application No. A 50681/2013 filed 22 Oct. 2013, the entire contents of each of which are hereby incorporated by reference.

The invention relates to a running surface for a ski, in particular for a cross-country ski, having a running surface profile which is provided, in particular, in a central longitudinal portion of the running surface and has slideback prevention elements with sliding surfaces which slope up counter to a sliding direction and transition into push-off flanks, wherein the slideback prevention elements have at least one first ramp element having a sliding surface convexly curved in longitudinal direction with a first radius of curvature and at least one second ramp element.

Furthermore, the invention relates to a cross-country ski having a sliding element which comprises a running surface.

In the prior art, different running surfaces for cross-country skis are known, wherein slideback is prevented by a profiling of the running surface. Typically, the running surface profile comprises scale elements that are positioned in an inclined manner with respect to the sliding direction and/or concavely depressed in the longitudinal direction of the ski, making it possible to obtain a good push-off effect. However, a disadvantage is that the sliding ability of the cross-country ski is being limited.

In addition to this, ski running surfaces in which convexly curved profilings are provided have already been proposed in the prior art. This makes it possible to obtain lower friction when sliding forward while at the same time, however, the effect of the push-off edges is compromised.

Moreover, U.S. Pat. No. 4,178,012 A describes a ski running surface having scale-like slideback prevention elements which are shaped convexly in both the longitudinal and the transverse direction. The individual elements are arranged adjacent in the transverse direction over the entire width of the ski, with a central groove extending in the longitudinal direction, which may also have slideback prevention elements. The individual rows of adjacent elements are arranged offset from one another.

EP 0049427 A1 discloses a running base coating for skis having an embossed push-off aid, which is formed by a plurality of hexagonal steps including push-off flanks that are steeply sloping down in the push-off direction and ramps that are extending evenly in the sliding direction. The hexagonal steps may be curved convexly in the longitudinal direction. Moreover, it is noted that the top face of the individual steps may be inclined and/or curved differently in the longitudinal direction in various portions of their length. However, this only makes it possible to obtain a reduction of the slideback prevention outside of the central region.

A running base coating for a cross-country ski having at least three groups of steps, one of which is arranged in the region of the tip of the ski, one in the region of the binding and one at the end of the ski, is known from AT 311 844 B, with the region between the groups of steps extending evenly.

Moreover, a profiled running surface for a cross-country ski in which slide-preventing protrusions are provided having a convexly curved surface in the longitudinal section has become known from DE 2 243 229. Due to the curved surface contact area, lower friction when sliding forward is to be obtained without excessively reducing the effect of the push-off edges. However, this objective cannot be obtained satisfactorily using the design of the prior art.

DE 1 954 075, DE 78 16 929 U1 and CH 306 405 describe further skis in which the running surface comprises convex elevations in order to obtain a slideback protection.

Finally, a running base profile for a cross-country ski having inclined surfaces sloping up towards the rear, to the end of the ski, has been proposed in DE 30 24 364 A1. Here, the inclined surfaces are composed of at least two inclined sections having different angles with respect to the plane of the running base. In the region of the inclined surfaces, drop-shaped indentations are provided for achieving a compression of the snow within the indentations. The known design having the comparably small depressions in the inclined surfaces, however, does not provide a satisfactory solution for improving the push-off behaviour without compromising the sliding ability in the forward direction.

In contrast to this, the object of the present invention is to provide a running surface for a cross-country ski as initially mentioned, which is designed to improve the push-off ability of the running surface profile while obtaining a sliding ability in the sliding direction which is as good as possible at the same time.

For achieving this object, it is provided, according to the invention, for the second ramp element to comprise a sliding surface convexly curved in longitudinal direction with a second radius of curvature which is larger than that of the first ramp element.

According to the invention, the running surface profile thus has two different ramp elements. On the one hand, a convexly curved first ramp element, i. e. bent outside with respect to the longitudinal plane of the running surface, is provided, having a beneficial effect on the sliding ability of the cross-country ski. On the other hand, a second ramp element is provided for improving the push-off ability without compromising the improved sliding ability due to the convex first ramp element. For this purpose, the second ramp element has a convex curvature which is less pronounced than that of the first ramp element. In this way, it is possible to make a comparably large amount of snow beneath the second ramp element compressible during cross-country skiing, thus facilitating the push-off procedure.

An especially good trade-off between good sliding and push-off properties is obtained when the radius of curvature of the second ramp element is at least 4 times, preferably at least 10 times, in particular between 15 and 20 times, as large as the first radius of curvature. In practice, it has proven particularly advantageous for the first radius of curvature of the first ramp element to be between 10 and 40 mm, in particular substantially 20 mm, and the second radius of curvature of the convexly curved second ramp element to be between 200 and 500 mm, in particular substantially 360 mm. Furthermore it is favourable for each of the first and second ramp elements to extend over 2 to 10 mm, preferably over 3 to 7 mm, in particular over substantially 5 mm, in the longitudinal direction. Preferably, the ramp elements are made in the running surfaces by means of cutting blades. Accordingly, cutting blades having a convex surface line corresponding to the respective radii of curvature of the ramp elements are rotated around an axis of rotation in order to make ramp elements having a length of preferably approx. 5 mm in the running surface between two push-off flanks of the running surface.

In order to achieve a good trade-off between a good sliding and push-off behaviour, it is also advantageous for the share of the extension of the sliding surface of the first ramp element with respect to the surface comprising a running surface profile having slideback prevention elements to be between 3% and 60%, preferably between 5 and 50%, in particular substantially 20%. The higher the share of the comparably slightly curved ramp surfaces is, the better the push-off behaviour is. Within the aforementioned boundaries, however, a good sliding behaviour is maintained as well.

If the second ramp element adjoins the first ramp element directly in the longitudinal direction, good sliding properties in the forward and/or sliding direction may be combined with a favourable slideback prevention in the backward direction, i. e. counter to the sliding direction. Moreover, this design is to be preferred for reasons of manufacture. Using this design, the relation according to the invention between the extension of the sliding surface of the first ramp element and the extension of the sliding surface of the second ramp element, in particular, may be formed.

Concerning the profiling of the running surface, it is particularly favourable for the slideback prevention elements to comprise first ramp elements and second ramp elements alternating in the longitudinal direction of the running surface. According to a preferred design, a plurality of slideback prevention elements is provided, formed as first ramp elements and second ramp elements alternating in the longitudinal direction. On the other hand, only single first or second ramp elements may be arranged one after another, with possible additional profile elements being present between such groups of first or second ramp elements.

Moreover, the running surface profile may be strengthened by the slideback prevention elements having at least one first ramp element and at least one second ramp element in the transverse direction of the running surface, which preferably transition directly into one another. As a consequence, a design in which first ramp elements and second ramp elements are provided alternating in both the longitudinal direction and the transverse direction is particularly preferred.

In order to avoid the forming of too small ramp elements while not removing too much material from the running surface when cutting the ramp elements in a preferred manner, it is provided, according to a first preferred design, for a ramp element, in particular the second ramp element, to be concavely curved in the transverse direction of the running surface according to a third radius of curvature, wherein the third radius of curvature is between 100 and 200 mm, in particular substantially 155 mm. As a consequence, the ramp element in this design has a convex curvature seen in the longitudinal direction, but a concave curvature seen in the transverse direction.

Here, it is also particularly advantageous if a ramp element, in particular the first ramp element, is concavely curved in the transverse direction of the running surface according to a fourth radius of curvature, wherein the fourth radius of curvature is preferably between 100 and 200 mm, in particular substantially 155 mm. According to this, in particular concavely curved ramp elements, possibly with different radii of curvature, may be arranged alternating in the transverse direction. By means of an overlaying arrangement of the concavely curved ramp elements adjoining one another, a corrugated structure, which has proven particularly advantageous for the compression of snow, is substantially obtained in the transverse direction. It is also advantageous here if the concave radii of curvature of the ramp elements provided in the transverse direction of the running surface are substantially equal.

The object underlying the invention is also achieved by a cross-country ski of the initially mentioned type in which the running surface is designed according to any one of claims 1 to 12.

Regarding the advantages and technical effects of such a cross-country ski, reference is made to the above statements concerning the running surface according to the invention.

The invention is discussed in more detail below by means of exemplary embodiments illustrated in the figures, however without being limited to them.

Figure 1:
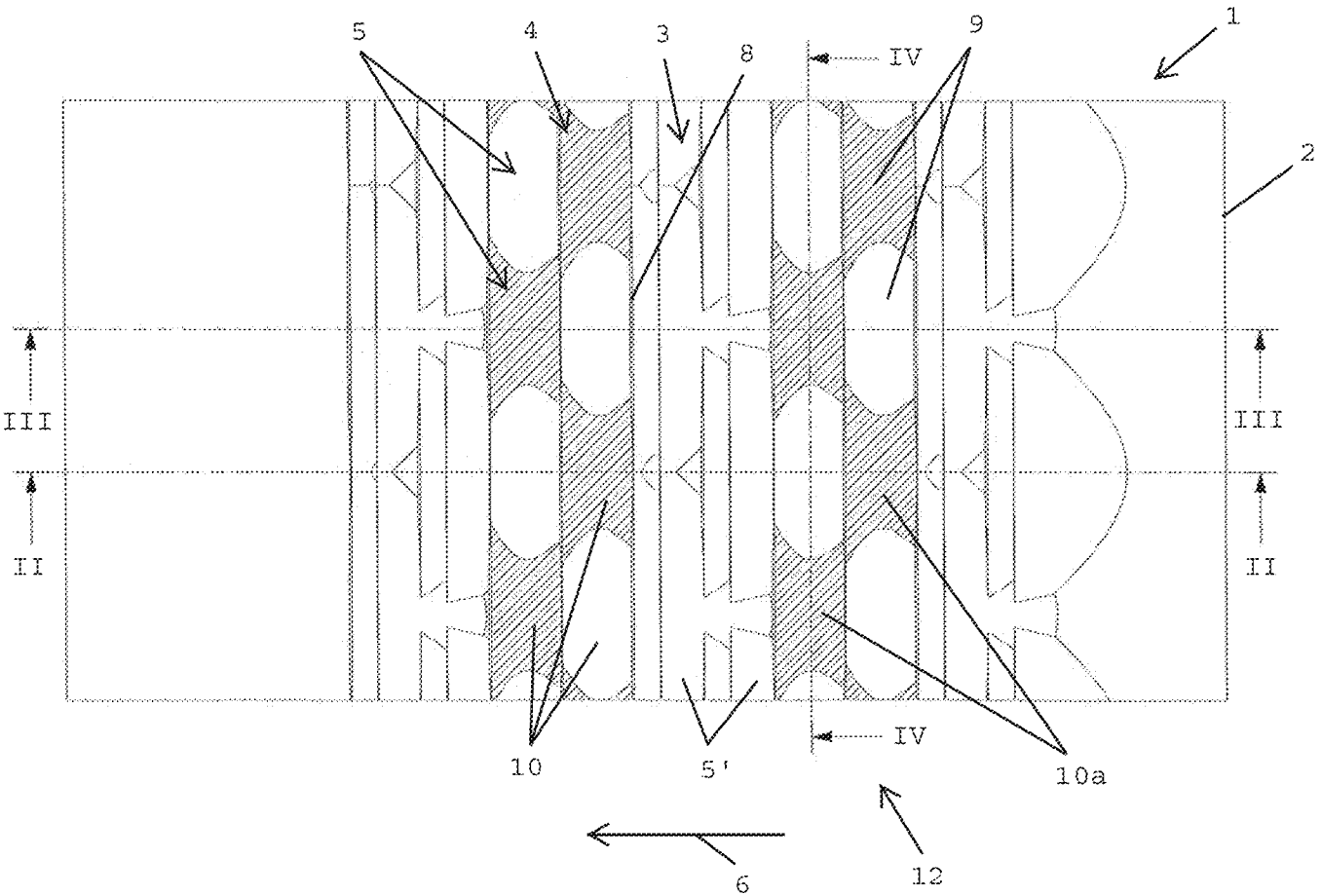
FIG. 1 shows a view of a portion of a cross-country ski which has a running surface including slideback prevention elements on the bottom face, which are composed of two types of convexly curved ramp elements, seen in the longitudinal direction of the ski, with different radii of curvature.

FIG. 1 shows a section of a cross-country ski 1 having a sliding element 2 formed in a known manner which has a running surface 3 on the bottom face. In the illustrated region, which is beneath a ski binding (not shown), the running surface 3 has a running surface profile 4 for preventing slideback during cross-country skiing. The running surface profile 4 comprises slideback prevention elements 5 having sliding surfaces 10 sloping up counter to a sliding direction 6. At the rear end with respect to the sliding direction 6, the sliding surfaces 10 slope down to form push-off flanks 8 which extend substantially perpendicular to the longitudinal direction of the running surface 3. In the embodiment shown, the slideback prevention elements 5 are formed by ramp elements 9.

Figure 2:
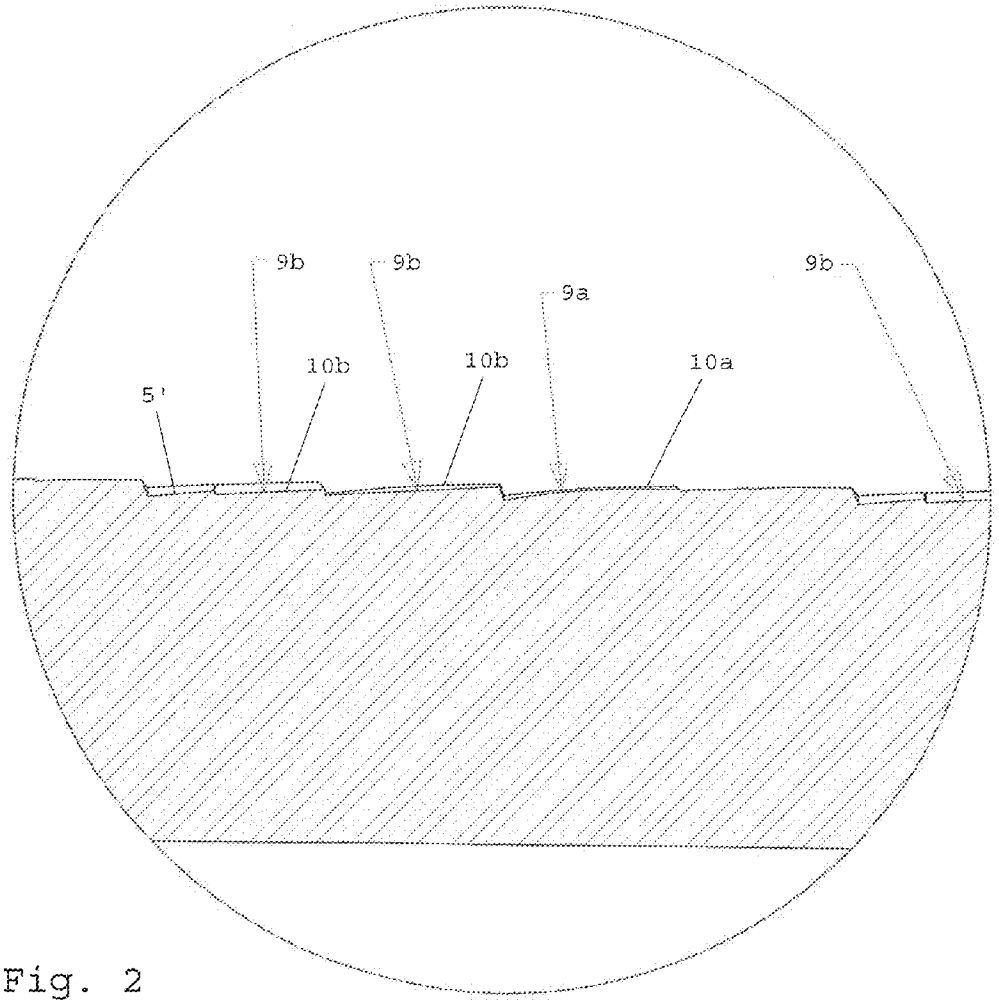
FIG. 2 is an enlarged sectional view along line II-II of FIG. 1.
Figure 3:
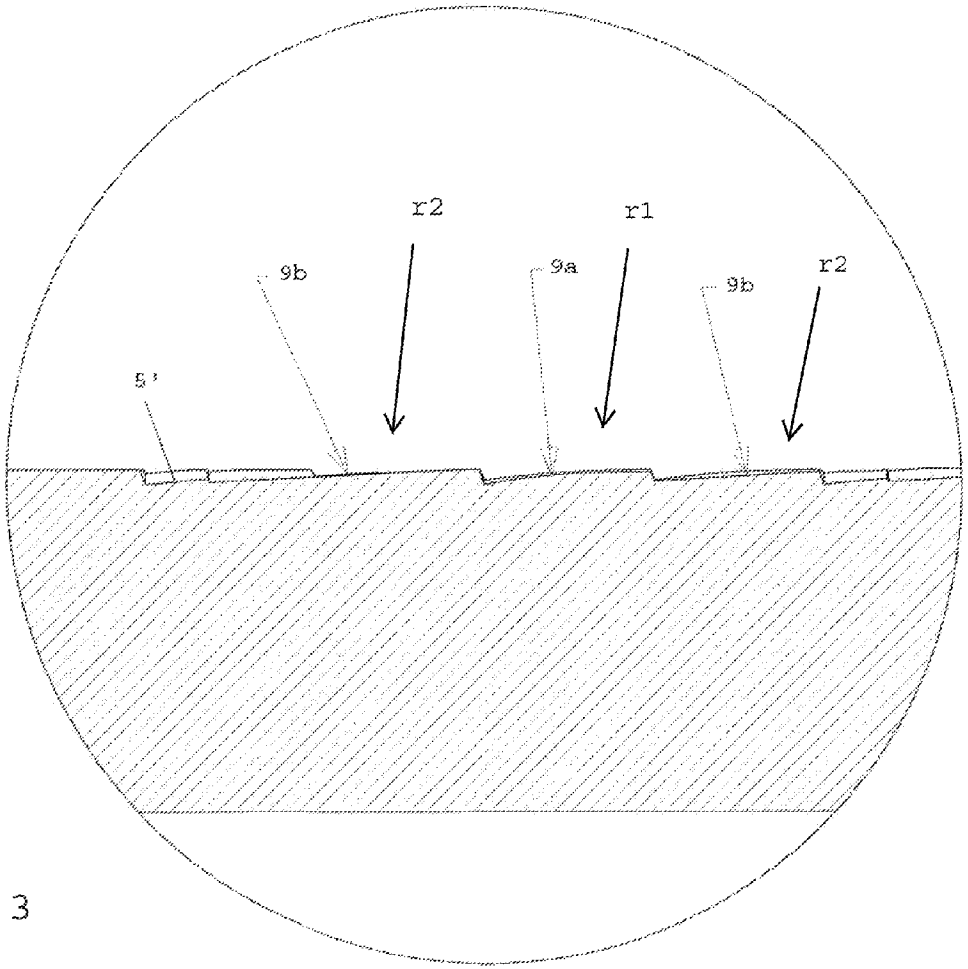
FIG. 3 is an enlarged sectional view along line III-III of FIG. 1.

As can be seen from FIGS. 1 to 3, the slideback prevention elements 5 comprise two types of ramp elements 9, in particular, with first ramp elements 9*a* and second ramp elements 9*b* being provided. The first ramp elements 9*a* have convexly curved sliding surfaces 10*a*, i. e. bent outside with respect to the running surface 3, with a first radius of curvature r1 of approx. 20 mm. In the design shown, the second ramp elements 9*b* also comprise convexly curved sliding surfaces 10*b*, however formed with a second radius of curvature r2 many times larger than that of the first ramp elements 9*a*. In the design shown, the second radius of curvature r2 is approx. 360 mm, resulting in substantially even sliding surfaces 10*b*.

As can be seen from FIG. 1 in particular, in which the sliding surfaces 10*a* are illustrated shaded for better visibility, the share of the area of the sliding surfaces 10*a* with respect to the total area of the running surface profile 4 including slideback prevention elements 5, 5' and/or a repeat unit of the running surface profile 4 (50 mm in the exemplary embodiment shown) is substantially 20%. In this way, the push-off behaviour of the cross-country ski may be improved while obtaining a particularly good sliding ability of the cross-country ski.

As can further be seen from FIGS. 1 to 3, the first 9*a* and second ramp elements 9*b* are arranged in groups 12. The groups 12 of ramp elements 9 have a first 9*a* and a second ramp element 9*b* one after another in the longitudinal direction. In the transverse direction, alternating first 9*a* and second ramp elements 9*b* are provided as well.

Between the groups 12 of ramp elements 9, further slideback prevention elements 5' are provided. The further slideback prevention elements 5' are composed of rows of stepped ramps that are formed sawtooth-like in their longitudinal section. The stepped ramps include a secondary step having push-off edges of its own, which is positioned lower than the push-off edges of the stepped ramps. Such a running surface profile 4 is known from EP 0 592 384 B1.

Figure 4:
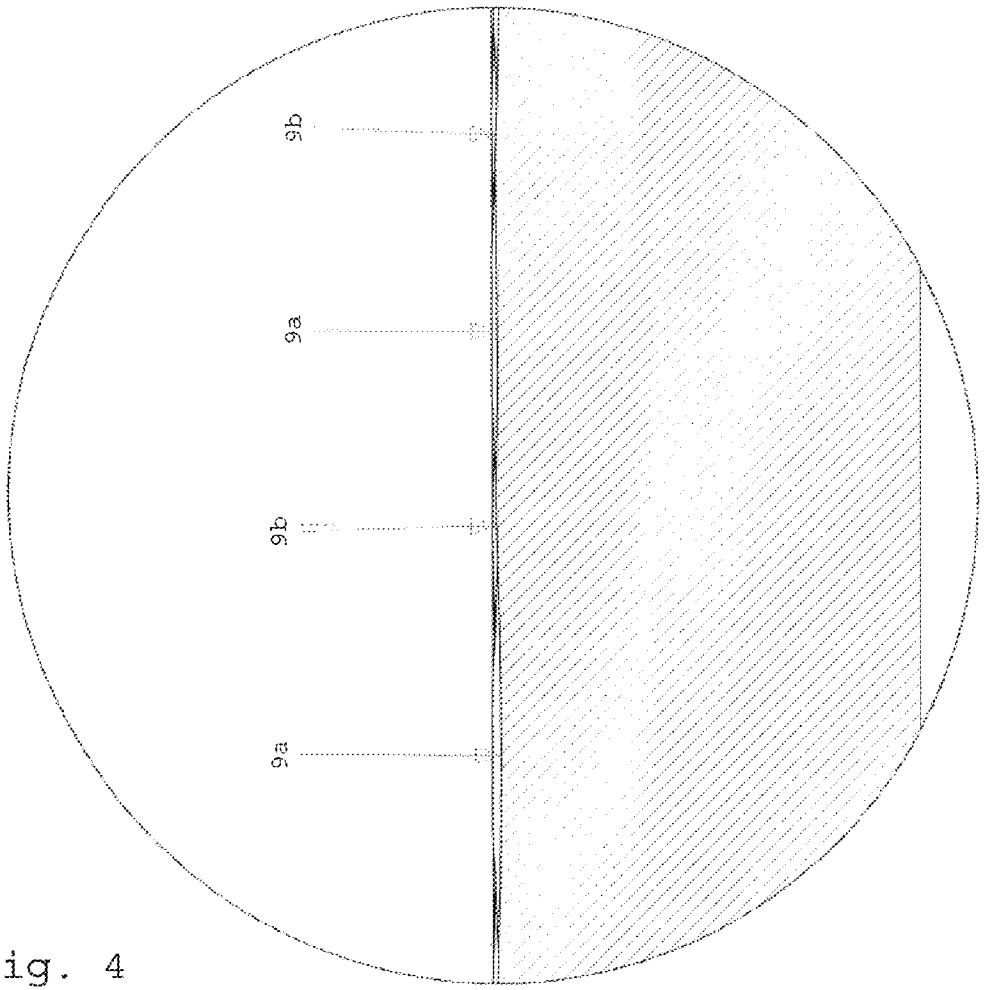
FIG. 4 is an enlarged sectional view along line IV-IV of FIG. 1.

FIG. 4 shows the design of the ramp elements 9 in the transverse direction of the running surface 3. In the exemplary embodiment shown, the second ramp element 9*b* has a concave curvature in transverse direction with a third radius of curvature r3, wherein the third radius of curvature r3 is 155 mm in the design shown. In this design, the sliding surface 10*a* of the first ramp element 9*a* has a concave curvature in transverse direction with a fourth radius of curvature r4, wherein the fourth radius of curvature r4 is also 155 mm in the design shown. Here, the concave radii of curvature r3, r4 are overlaid, advantageously resulting in a corrugated structure in the transverse direction of the running surface.

Such a design prevents forming too small ramp elements 9 while not removing too much from the running surface when cutting the ramp elements 9 in a preferred manner, either. Of course, however, the radii of curvature r3, r4 may also be chosen to be different.

Figure 5:
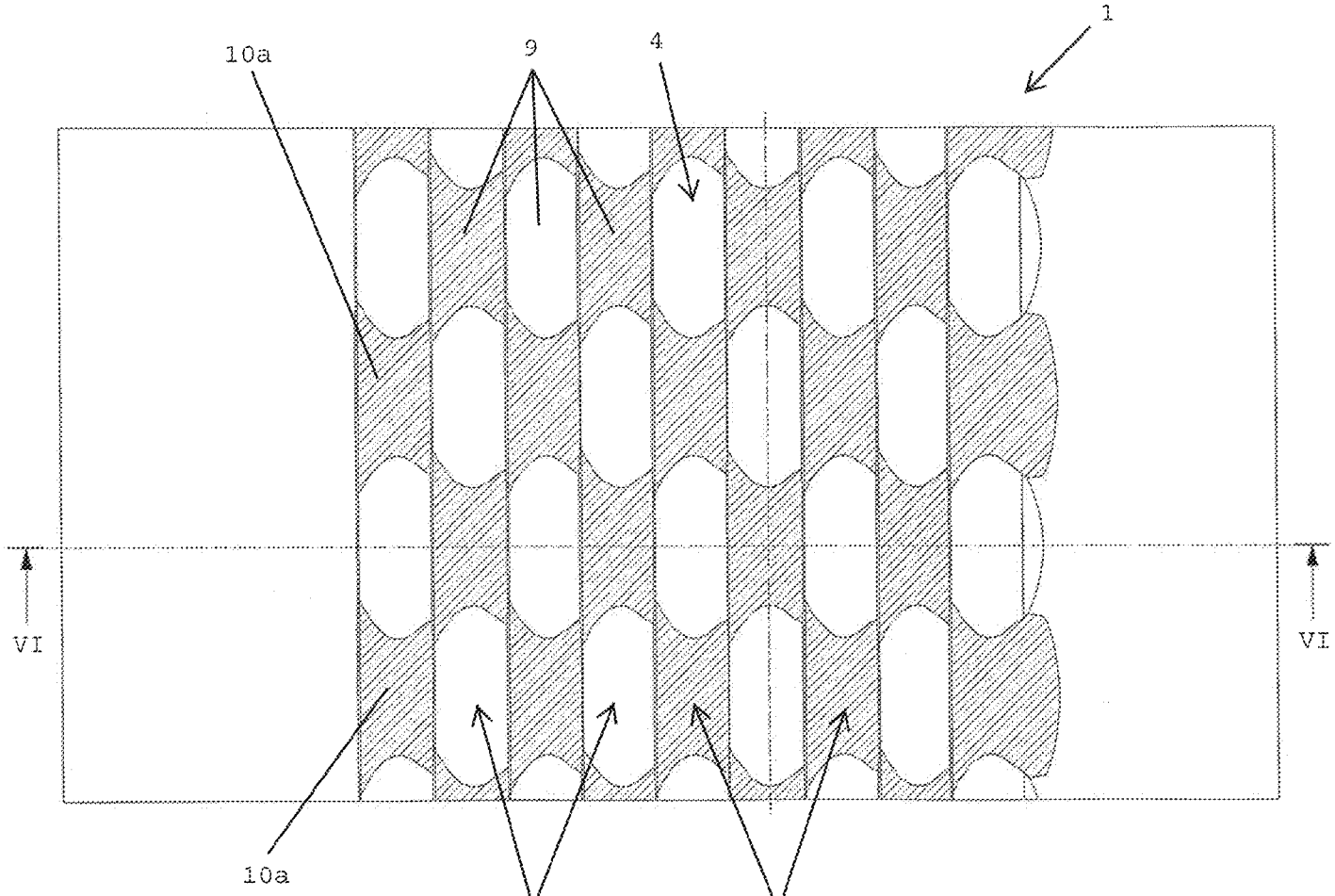
FIG. 5 is an alternative design of the slideback prevention elements.
Figure 6:
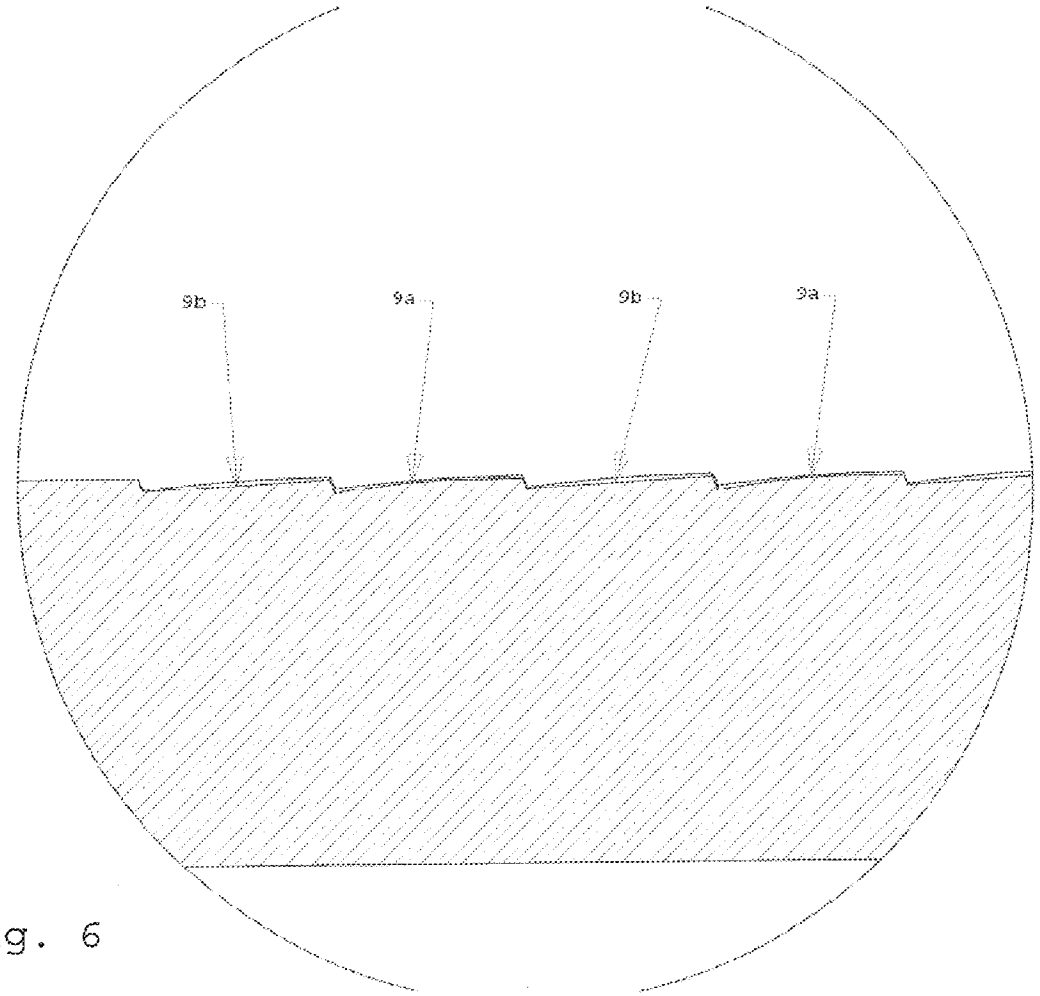
FIG. 6 is an enlarged sectional view along line VI-VI of FIG. 5.
Figure 7:
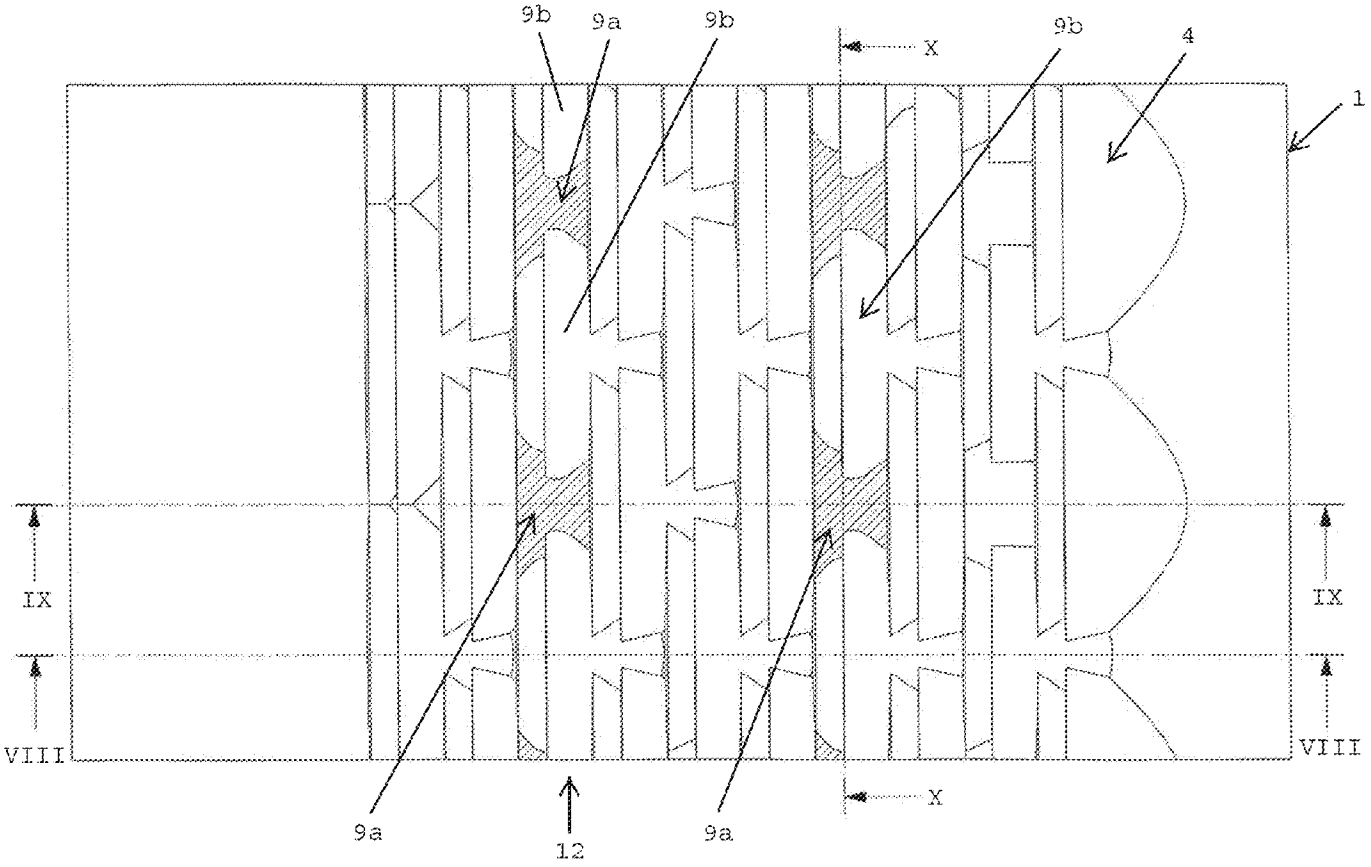
FIG. 7 is a view of a cross-country ski having a further alternative design of the running surface.

FIGS. 5 and 6 show another exemplary embodiment in which each of the second ramp elements 9*b* adjoins the first ramp element 9*a* directly in the longitudinal direction of the cross-country ski. According to this, first ramp elements 9*a* and second ramp elements 9*b* are provided alternating longitudinally in the embodiment shown. In the transverse direction of the running surface, alternating first ramp elements 9*a* and second ramp elements 9*b* are provided as well, with adjacent ramp elements 9*a*, 9*b* directly transitioning into one another.

Due to this, a significantly increased share of the area of the sliding surfaces 10*a* with respect to the total area of the running surface profile 4 including slideback prevention elements 5 and/or a repeat unit of the running surface profile 4 (50 mm in the exemplary embodiment shown) is obtained in this exemplary embodiment in contrast to the design according to FIGS. 1 to 4. Because of the alternating design in the longitudinal and the transverse directions, a share of the area of approx. 50% is obtained.

A further exemplary embodiment according to the invention is shown in FIGS. 7 to 10.

Here, a running surface profile 4 is shown, including mainly stepped ramps, each having a secondary step with a push-off edge of its own which is positioned lower than the push-off edges of the stepped ramps; such secondary steps are known from EP 0 592 384 B1 in particular.

Figure 8:
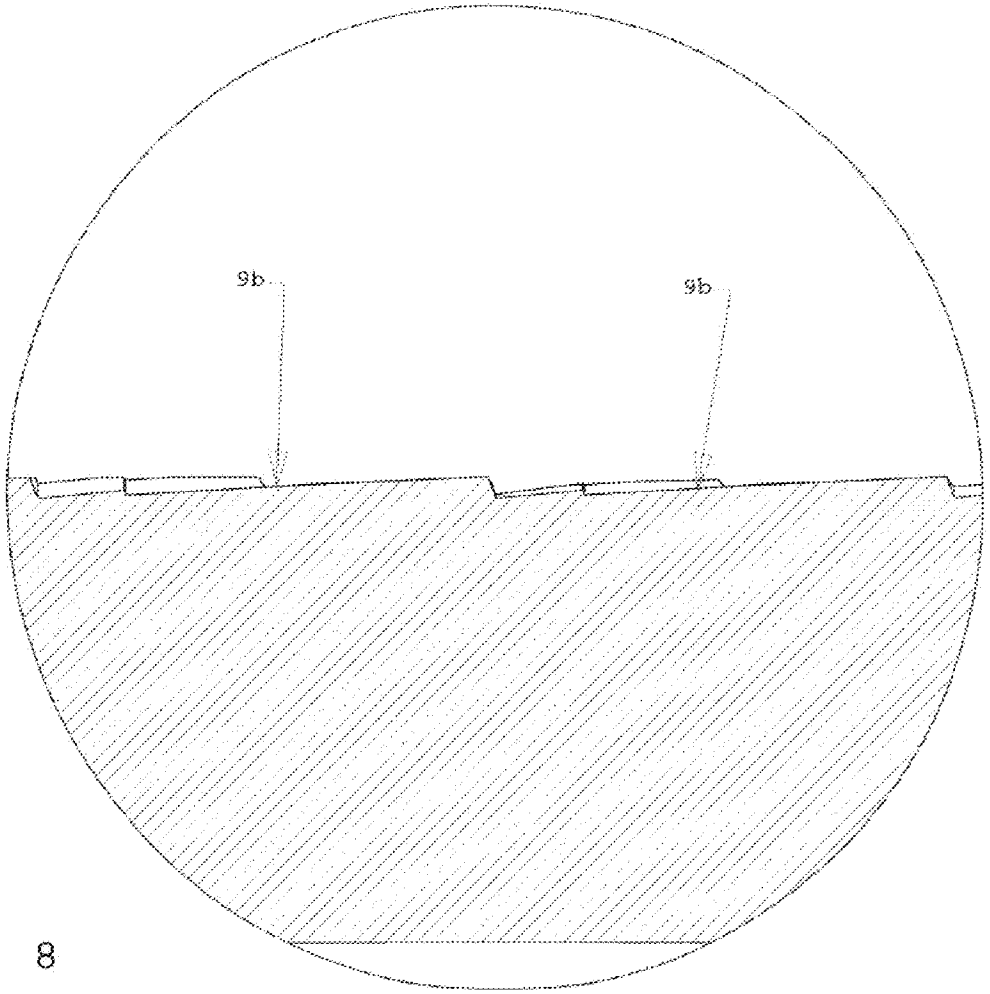
FIG. 8 is an enlarged sectional view along line VIII-VIII of FIG. 7.

As can be seen from FIG. 8, ramp elements 9*b* having a radius of curvature r2 of approx. 360 mm are provided as part of these stepped ramps having a secondary step.

Figure 9:
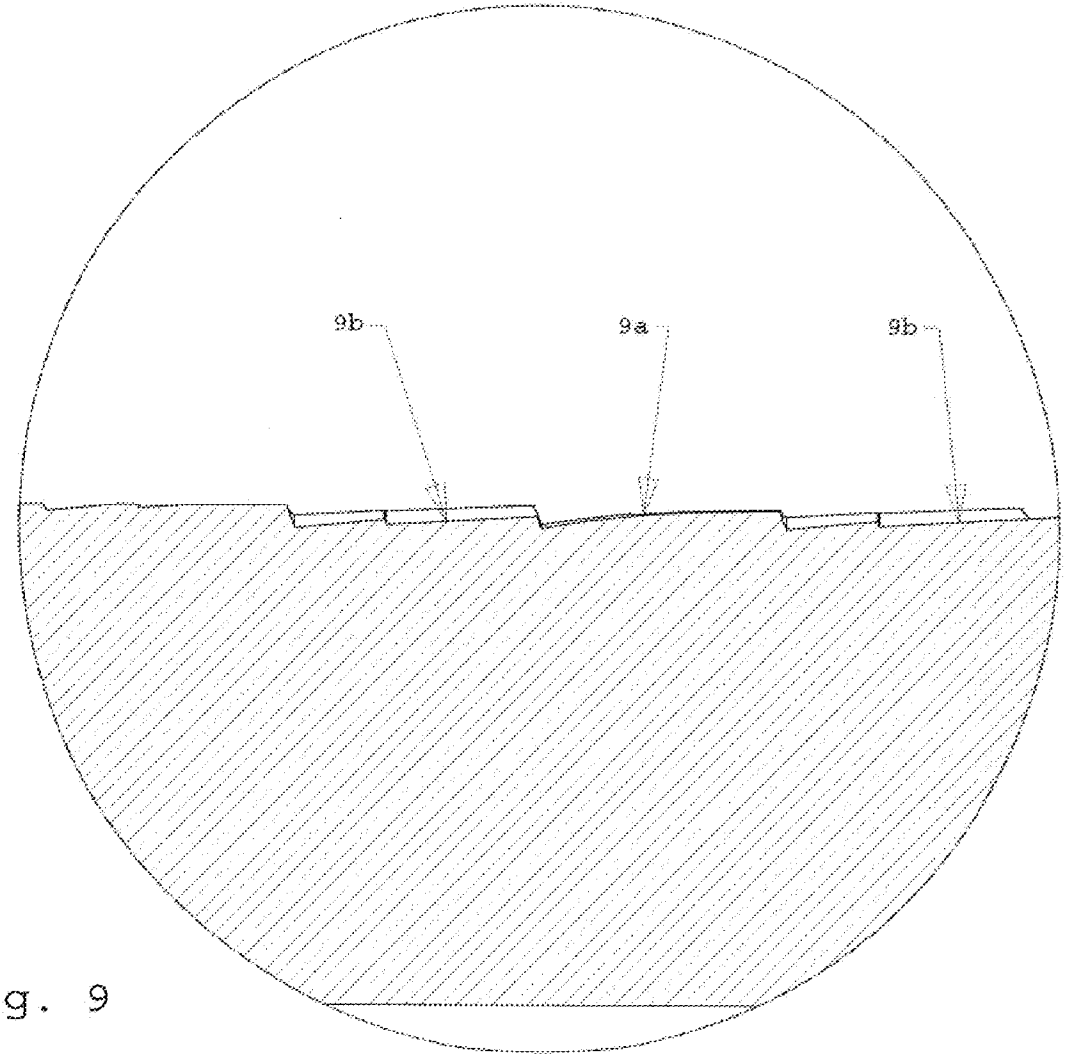
FIG. 9 is an enlarged sectional view along line IX-IX of FIG. 7.
Figure 10:
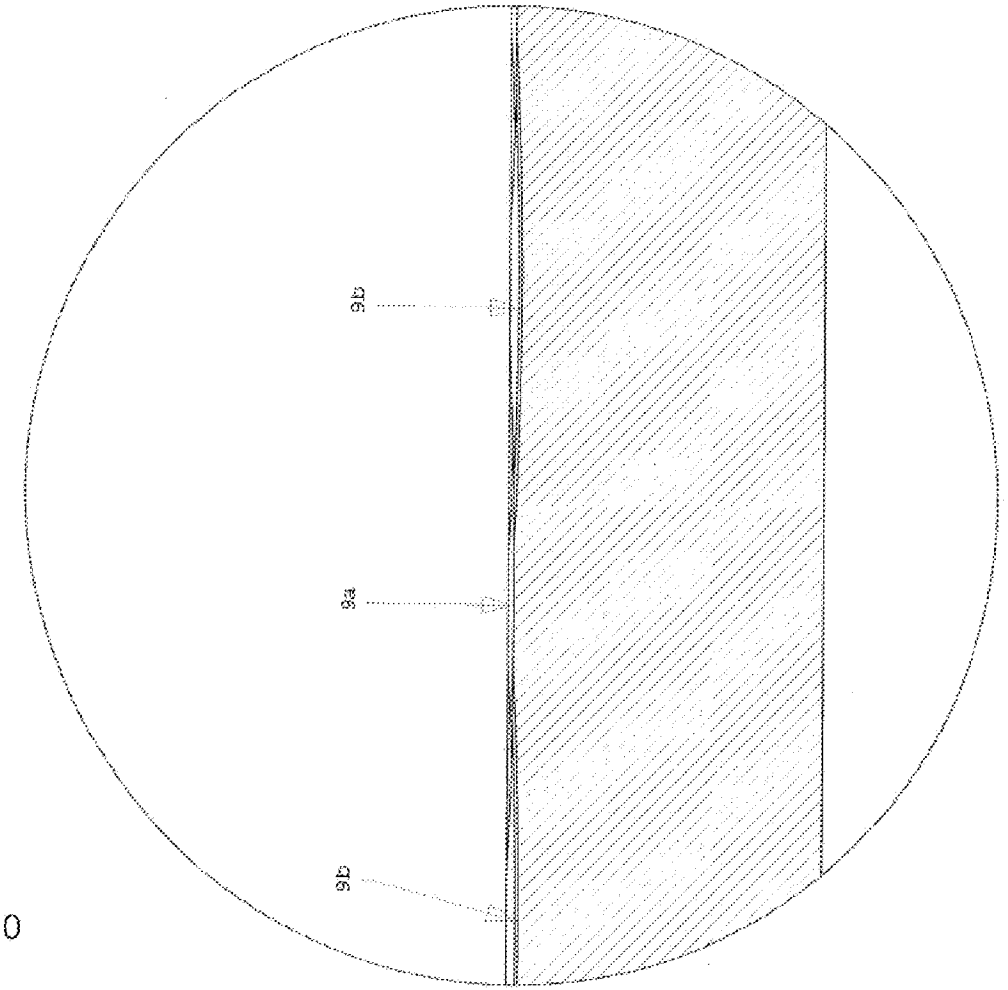
FIG. 10 is an enlarged sectional view along line X-X of FIG. 7.

In addition, however, regions are provided in the running surface profile 4 in which—as can be seen from FIG. 9—a ramp element 9*a* having a comparably small radius of curvature of approx. 20 mm seen in the longitudinal direction directly adjoins a ramp element 9*b* having the comparably large radius of curvature r1 of approx. 360 mm.

Due to this, a significantly decreased share of the area of the sliding surfaces 10*a* with respect to the total area of the running surface profile 4 including slideback prevention elements 5 and/or a repeat unit of the running surface profile 4 (50 mm in the exemplary embodiment shown) is provided in this exemplary embodiment in contrast to the above statements. Substantially, a share of the area of approx. 8% is obtained, resulting in excellent push-off properties, in particular, for this exemplary embodiment.

The invention claimed is:

1. A running surface for a ski having a running surface profile which has slideback prevention elements with sliding surfaces which slope up counter to a sliding direction and transition into push-off flanks, wherein the slideback prevention elements have at least one first ramp element having a sliding surface convexly curved in longitudinal direction with a first radius of curvature (r1) and at least one second ramp element, wherein the second ramp element comprises a sliding surface convexly curved in longitudinal direction with a second radius of curvature (r2) which is larger than that of the first ramp element.

2. The running surface according to claim 1, wherein the radius of curvature (r2) of the second ramp element is at least 4 times as large as the first radius of curvature (r1).

3. The running surface according to claim 1, wherein the first radius of curvature (r1) of the first ramp element is between 10 and 40 mm.

4. The running surface according to claim 1, wherein the second radius of curvature (r2) of the convexly curved second ramp element is between 200 and 500 mm.

5. The running surface according to claim 1, wherein each of the first and second ramp elements extends over 2 to 10 mm in the longitudinal direction.

6. The running surface according to claim 1, wherein the share of the extension of the sliding surface of the first ramp element with respect to the surface comprising a running surface profile having slideback prevention elements is between 3% and 60%.

7. The running surface according to claim 1, wherein the second ramp element adjoins the first ramp element directly in the longitudinal direction of the running surface.

8. The running surface according to claim 1, wherein the slideback prevention elements comprise first ramp elements and second ramp elements alternating in the longitudinal direction of the running surface.

9. The running surface according to claim 1, wherein the slideback prevention elements have at least one first ramp element and at least one second ramp element in the transverse direction of the running surface.

10. The running surface according to claim 1, wherein a ramp element is concavely curved in the transverse direction of the running surface according to a third radius of curvature (r3), wherein the third radius of curvature (r3) is between 100 and 200 mm.

11. The running surface according to a claim 1, wherein a ramp element is concavely curved in the transverse direction of the running surface according to a fourth radius of curvature (r4), wherein the fourth radius of curvature (r4) is between 100 and 200 mm.

12. The running surface according to claim 1, wherein the radii of curvature (r3, r4) of the ramp elements provided in the transverse direction of the running surface are substantially equal.

13. A cross-country ski having a sliding element comprising a running surface, wherein the running surface is designed according to claim 1.

14. The running surface according to claim 1, wherein the ski is a cross-country ski.

15. The running surface according to claim 1, wherein the running surface profile is in a central longitudinal portion of the running surface.

16. The running surface according to claim 1, wherein the radius of curvature (r2) of the second ramp element is at least 10 times as large as the first radius of curvature (r1).

17. The running surface according to claim 1, wherein the radius of curvature (r2) of the second ramp element is between 15 and 20times as large as the first radius of curvature (r1).

18. The running surface according to claim 1, wherein the first radius of curvature (r1) of the first ramp element is about 20 mm.

19. The running surface according to claim 1, wherein the second radius of curvature (r2) of the convexly curved second ramp element is about 360 mm.

20. The running surface according to claim 1, wherein each of the first and second ramp elements extends over 3 to 7 mm in the longitudinal direction.

21. The running surface according to claim 1, wherein each of the first and second ramp elements extends over about 5 mm in the longitudinal direction.

22. The running surface according to claim 1, wherein the share of the extension of the sliding surface of the first ramp element with respect to the surface comprising a running surface profile having slideback prevention elements is between 5 and 50%.

23. The running surface according to claim 1, wherein the share of the extension of the sliding surface of the first ramp element with respect to the surface comprising a running surface profile having slideback prevention elements is about 20%.

24. The running surface according to claim 1, wherein the slideback prevention elements have at least one first ramp element and at least one second ramp element in the transverse direction of the running surface, which transition directly into one another.

25. The running surface according to claim 1, wherein the second ramp element is concavely curved in the transverse direction of the running surface according to a third radius of curvature (r3), wherein the third radius of curvature (r3) is between 100 and 200 mm.

26. The running surface according to claim 1, wherein the second ramp element is concavely curved in the transverse direction of the running surface according to a third radius of curvature (r3), wherein the third radius of curvature (r3) is about 155 mm.

27. The running surface according to claim 1, wherein the first ramp element is concavely curved in the transverse direction of the running surface according to a fourth radius of curvature (r4), wherein the fourth radius of curvature (r4) is between 100 and 200 mm.

28. The running surface according to claim 1, wherein the first ramp element is concavely curved in the transverse direction of the running surface according to a fourth radius of curvature (r4), wherein the fourth radius of curvature (r4) is about 155 mm.

* * * * *